United States Patent [19]

Brewer et al.

[11] 4,123,337

[45] Oct. 31, 1978

[54] METHOD OF IMPROVING THE SURFACE INSULATION RESISTANCE OF ELECTRICAL STEELS HAVING AN INSULATIVE COATING THEREON

[75] Inventors: David C. Brewer, Miamisburg; James D. Evans; Dale M. Kohler, both of Middletown; Michael H. Haselkorn, Franklin, all of Ohio

[73] Assignee: Armco Steel Corporation, Middletown, Ohio

[21] Appl. No.: 847,760

[22] Filed: Nov. 2, 1977

[51] Int. Cl.[2] ..... C25F 3/06; C25F 3/14; C25F 3/24

[52] U.S. Cl. ..... 204/129.3; 204/129.35

[58] Field of Search ..... 204/145 R, 146, 129.65, 204/144.5, 129.3, 129.35

[56] References Cited

U.S. PATENT DOCUMENTS

| | | | |
|---|---|---|---|
| 2,122,463 | 7/1938 | Fuller | 204/129.3 |
| 2,374,449 | 4/1945 | Mulcahy | 204/144.5 |
| 2,607,825 | 8/1952 | Eisler | 204/129.65 |
| 2,820,003 | 1/1958 | Logan | 204/145 R |
| 3,043,758 | 7/1962 | Machu | 204/145 R |
| 3,073,943 | 1/1963 | Girling et al. | 204/129.3 |
| 3,644,185 | 2/1972 | Benford | 204/129.35 |

*Primary Examiner*—T. M. Tufariello

*Attorney, Agent, or Firm*—Melville, Strasser, Foster & Hoffman

[57] ABSTRACT

A method of improving the surface insulation resistance of electrical steels having an insulative coating thereon by subjecting the electrical steels to electrochemical treatment as part of the routing thereof, to remove small metallic nodules, particles and the like extending through or protruding above the insulative coating. Following the electrochemical treatment, the electrical steels are rinsed and dried.

13 Claims, No Drawings

METHOD OF IMPROVING THE SURFACE INSULATION RESISTANCE OF ELECTRICAL STEELS HAVING AN INSULATIVE COATING THEREON

BACKGROUND OF THE INVENTION

1. Field of the Invention

The invention relates to a method of improving the surface insulation resistance of an electrical steel having an insulative surface coating thereon, and more particularly to the subjecting of an electrical steel to at least one electrochemical treating step to remove small metallic particles, nodules or the like extending through or protruding above the insulative coating and which can result in increased watt loss in laminated magnetic structures excited with alternating current because of reduced resistance to interlaminar current flow.

2. Description of the Prior Art

The present invention is applicable to oriented silicon steels with a mill glass coating, carbon steels for electrical uses having an insulative coating thereon, and cold rolled non-oriented silicon steels with an applied insulative coating. The terms "electrical steel" or "electrical steels," as used herein and in the claims, is to be interpreted as encompassing the above noted types of steels. For purposes of an exemplary showing, the present invention will be described in its application to the manufacture of oriented silicon steels. As used herein and in the claims, the term "oriented silicon steel" refers to silicon steel wherein the body-centered cubes making up the grains or crystals are oriented in a cube-on-edge position, designated (110) [001] in accordance with Miller's indices.

Oriented silicon steels are well known in the art and have been chosen for purposes of an exemplary teaching of the present invention because in their typical applications, as for exmaple in the manufacture of transformer cores and the like, surface insulation resistance is of considerable importance.

In recent years prior art workers have devised various routings for the manufacture of oriented silicon steel which have resulted in markedly improved magnetic characteristics. As a result, such oriented silicon steels are now considered to fall into two general catagories. The first catagory is usually referred to as high permeability oriented silicon steel and is made by routings which consistently produce a product having a permeability at 796A/m of greater that about 1850 and typically greater than about 1900. U.S. Pat. No. 3,287,183; 3,636,579; 3,873,234 are typical of those which teach routings for high permeability oriented silicon steel. The second catagory is generally referred to as regular oriented silicon steel and is made by those routings normally producing a permeability of less than about 1850. U.S. Pat. No. 3,764,406 is typical of those which set forth routings for regular oriented silicon steel. The teachings of the present invention are applicable to both types of oriented silicon steel.

With both types of oriented silicon steel the basic steps of the manufacturing process or routing include casting a melt into ingots which are rolled into slabs or continuously casting the melt into slab form. The slabs are reheated, hot rolled to hot band thickness, annealed and cold rolled to final gauge in one or more stages. Following cold rolling, the silicon steel is subjected to a decarburizing step, provided with an annealing separator and subjected to a final box anneal during which the desired final magnetic characteristics are for the most part achieved.

While the above lists the basic steps of the routings for oriented silicon steel, other steps may be included and the precise nature of the routing does not constitute a limitation on the present invention.

In the manufacture of high permeability oriented silicon steel an exemplary melt composition in weight percent may be stated as follows:

Si 2%–4%
C less than 0.085%
Al (Acid-soluble) up to 0.065%
N 0.003%–0.010%
Mn 0.02%–0.2%
S and/or Se 0.015%–0.07%
B up to 0.012%
Cu up to 0.5%

Similarly, in the manufacture of regular oriented silicon steel, a typical melt composition by weight percent may be set forth as follows:

C less than 0.085%
Si 2%–4%
S and/or Se 0.015%–0.07%
Mn 0.02%–0.2%

In the manufacture of either type of oriented silicon steel the most common practice is to provide, prior to the final anneal, an annealing separator which (during the final anneal) will form an insulative glass film on the surfaces of the oriented silicon steel. Magnesia, for example, is a typical annealing separator which forms an insulative glass film, as taught in U.S. Pat. Nos. 2,385,332 and 2,906,645. Other exemplary annealing separators are set forth in U.S. Pat. Nos. 3,544,396 and 3,615,918. The insulative glass coating formed by such annealing separators is generally known in the art as a "mill glass". For purposes of this description, such insulative coatings will be termed "primary coatings".

In the manufacture of carbon steels for electrical applications and cold rolled non-oriented silicon steels, a surface insulative coating may be applied. This coating may be of the type caught in U.S. Pat. Nos. 2,501,846 and 3,996,073, or an organic type as taught in U.S. Pat. Nos. 3,865,616; 3,853,971 and 3,908,066. These coatings, which are applied to improve the interlaminar resistance, are intended to be included in the term "primary coatings," as used herein and in the claims.

Excellent surface insulation resistance, or low amperes by the ASTM test method A717 (commonly referred to as the Franklin resistivity test method) is impaired by the presence of small metallic particles or the like extending through or protruding above the surface of the primary insulative coating. The present invention is based upon the discovery that if the oriented silicon steel, having a mill glass formed thereon, is subjected to a continuous electrochemical treatment step, an improvement in surface insulation will occur by virtue of the fact that any small metallic particles extending through or protruding above the mill glass are removed without harming the insulative characteristics of the primary insulative coating or mill glass. Depending upon the quality of the primary insulative coating, average surface insulation resistance improvements equivalent to a change in current of from about 0.67 to about 0.34 amps by ASTM test method 717 may be achieved.

In addition, it is usual practice in the manufacture of transformer cores and the like to provide a secondary coating over the primary coating. Exemplary secondary coatings are taught in U.S. Pat. Nos. 2,501,846 and 3,996,073. A primary function of such applied secondary coatings is to reduce interlaminar eddy currents. With the practice of the present invention less secondary coating may be required since there will be no metallic particles or the like extending through or protruding above the surface of the primary insulative coating. This results not only in a savings of material, but also in the improvement of the space factor characteristics of the oriented silicon steel. A heavy secondary coating is to be avoided since it results in increased cost, a tendency to powder, drying problems, furnace maintenance problems and pimpling of the secondary coating.

SUMMARY OF THE INVENTION

The surface insulation resistance of electrical steels having an insulative coating thereon is improved by subjecting the electrical steels to an electrochemical treatment as a part of the routing thereof.

The electrochemical treatment step may be performed on oriented silicon steel, for example, after the final anneal wherein the desired magnetic characteristics are largely achieved and during which a mill glass is usually formed. The electrochemical treatment step improves the surface insulation resistance of the primary insulative coating or millglass. The strip is caused to continuously pass through an aqueous solution of sodium nitrate or sodium chloride and constitutes the anode. The electrochemical treatment step is followed by rinsing and drying steps.

DESCRIPTION OF THE PREFERRED EMBODIMENTS

In its simplest form, the invention is practiced upon a cube-on-edge oriented silicon steel strip having a mill glass formed thereon. After the final high temperature anneal during which the desired magnetic properties are largely developed and during which the mill glass is formed, the steel is scrubbed to remove any excess annealing separator. Thereafter, the strip is caused to pass continuously through an electrolyte bath provided with a cathode of stainless steel or the like, the strip, itself, serving as the anode.

To reduce current requirements, two electrolyte baths may be provided, one for each side of the strip. Under these circumstances only one side of the strip will serve as the annode and will be treated in each bath. It will be understood by one skilled in the art that it is within the scope of the invention to treat both sides of the strip simultaneously; to treat the sides of the strip differentially; or to treat only one side of the strip. For purposes of clarity herein and in the claims the examples given and the discussion of current densities are set forth in terms of both sides of the strip being treated simultaneously and equally.

While any appropriate and well known electrolyte may be used, for purposes of an exemplary showing the invention will be discribed in terms of the use of an aqueous solution of sodium nitrate or sodium chloride as an electrolyte. The electrolyte concentration may be up to about 600 grams per liter of water for sodium nitrate and up to about 300 grams per liter of water for sodium chloride. The primary effect of the electrolyte concentration is on the conductivity of the electroyte. The higher the level of concentration, the higher the conductivity and the lower the electrical resistance. This effect of electrolyte concentration, however, decreases as the concentration is increased beyond the recommended concentrations given above. While the conductivity of the electrolyte solution has very little effect on the amount of material removed from the anode during the electrochemical treatment process, it is important when considering the amount of power dissipated during the electrochemical treatment process. The amount of power dissipated can be reduced both by increasing the electrolyte concentration and by decreasing the spacing between the cathode and the oriented silicon steel strip being treated.

During the electrochemical treatment step metal hydroxide, usually insoluble, is formed in the solution as the metal ions leave the anode. In small quantities the metal hydroxide does not significantly affect the process. If allowed to accumulate in large quantitites, however, the metal hydroxide can cause inefficiency and failure of the process. The metal hydroxide precipitate can be removed from the electrolyte through the use of centrifuge separators or gravity settling tanks, as is well known in the art.

In the process of electrochemical treatment, the quantity of metal ions liberated at the anode is independent of the temperature of the electrolyte, the type of electrolyte used or the concentration of the electrolyte. The amount of metal removed from the anode during the electrochemical treatment step is a function of electric current, time and the valence of the metal being treated.

In the practice of the present invention on electrical steels, a theoretical rate of removal can be calculated where the time of immersion in the electrolyte, the current and the valence of the substance being treated is known. The calculated rate of removal should be considered to be only a rough guide since actual valence changes do occur during the electrochemical treatment step. The oriented silicon steel to be treated may be considered, for this purpose, to be pure iron since the silicon of the steel is removed mechanically rather than electrolytically and the other elements of the silicon steel can be ignored due to the practical amounts present. Under these circumstances, the amount of material removed from the silicon steel (i.e. the anode) may be approximated using the following formula:

$$\text{grams removed} = AIt/ZF$$

where:

A = atomic weight = 55.84 for iron
I = current in amps
t = time in seconds
Z = valance = 2 for iron
F = Ne = Faraday's constant = 96500 coulombs
N = Avogadro's number = $6.025 \times 10^{23}$
$e$ = electron charge = $1.602 \times 10^{-19}$ Thus, using a current of 15 amps for an immersion time of 10 seconds, the amount of pure iron removed at the annode in 10 seconds would be:

$$[(55.84)(15)(10)/(2)(96500)] = 0.043 \text{ grams}$$

In the laboratory five series of samples designated A through E were selected, each representing a different quality of mill glass. Series A and B were regular oriented silicon steel, the remaining series C through E being high permeability silicon steel.

Each sample series contained nine strips measuring approximately $3 \times 17 \times 0.0305$ centimeters. The strips of each series were divided into two groups. For example, in series A the first five strips were designated A2–6 and the remaining four strips were designated A7–10. The remaining series were similarly divided. All strips numbered 2 through 6 were electrochemically treated (both sides simultaneously) in a sodium chloride electrolyte and all strips designated 7 through 10 were electrochemically treated (both sides simultaneously) in a sodium nitrate electrolyte. The electrochemical treatment step was performed on all of the strips for a time of 10 seconds at a current of 15 amps. Each strip was weighed to the nearest miligram and a measurement of surface insulation resistance was taken from each surface before treatment by ASTM test method A717. The strips were reweighed and retested for surface insulation resistance after treatment, again using ASTM test method A717. Approximately 12.5 centimeters of the length of each strip was immersed in the electrolyte so that, for the surface area treated, this resulted in a charge density of 2 coulombs/cm$^2$ (current density of 2000 amps per square meter). The results of this experiment are summarized in the following table.

TABLE I

| Sample Group | W1 | W2 | W3 | Wc | $I_1$ | $I_2$ | % | Electolyte |
|---|---|---|---|---|---|---|---|---|
| A2-6 | 52.759 | 52.597 | .162 | .217 | .316 | .045 | 85.8 | NaCl |
| A7-10 | 43.284 | 43.097 | .187 | .174 | .394 | .045 | 88.6 | $NaNO_3$ |
| B2-6 | 49.546 | 49.367 | .179 | .217 | .597 | .058 | 90.3 | NaCl |
| B7-10 | 39.458 | 39.277 | .181 | .174 | .603 | .026 | 95.7 | $NaNO_3$ |
| C2-6 | 56.984 | 56.764 | .220 | .217 | .486 | .240 | 50.6 | NaCl |
| C7-10 | 45.900 | 45.701 | .199 | .174 | .641 | .221 | 65.5 | $NaNO_3$ |
| D2-6 | 56.597 | 56.383 | .214 | .217 | .489 | .114 | 76.7 | NaCl |
| D7-10 | 44.452 | 44.266 | .186 | .174 | .493 | .046 | 90.7 | $NaNO_3$ |
| E2-6 | 59.770 | 59.553 | .217 | .217 | .831 | .675 | 18.8 | NaCl |
| E7-10 | 50.502 | 50.312 | .190 | .174 | .776 | .330 | 56.6 | $NaNO_3$ |

where

W1 = total weight in grams of the samples of each group before treatment.

W2 = total weight in grams of the samples of each group after treatment.

W3 = total weight in grams of material removed from the samples of each group.

Wc = total calculated weight in grams of material removed from the samples of each group.

$I_1$ = average current in amperes (by ASTM test method A717) of the samples of each group before treatment.

$I_2$ = average current in amperes (by ASTM test method A717) of the samples of each group after treatment.

% = average percent improvement in amperes of the samples of each group.

For convenience the average percent improvement in amperes by ASTM test method A717 can be used to reflect the surface insulation resistance improvement. The relationship between the ampere reading (I) from ASTM test method A717 and the interlaminar Resistance (Rs) in ohm-cm$^2$/lamination is given by the following equation:

$$Rs = 6.45\left(\frac{1}{I} - 1\right)$$

The difference in mill glass quality of the various sample groups is reflected in column I1 of Table I above. The table also shows that the total calculated weight in grams of material removed from the samples of each group roughly approximates the total weight in grams of material actually removed from the samples of each group. In general, the electrochemically treated strips demonstrated marked improvement in surface insulation resistance. The strips which were treated in the sodium nitrate electrolyte demonstrated a greater improvement in surface insulation resistance than the strip treated in the sodium chloride electrolyte. Furthermore, the amount of improvement in surface insulation resistance is related to the quality of the mill glass on the oriented silicon steel. In the above tests a stainless steel cathode was used.

In another test a series of samples were obtained from a single high permeability oriented silicon steel coil. The coil prior to the final anneal during which the majority of its magnetic properties were developed was provided with a magnesia annealing separator. The coil was chosen because the mill glass formed during the final anneal was of excellent quality.

The coil was sheared into samples 15.24 centimeters long and 7.7 centimeters wide which were immersed in a sodium nitrate electrolyte up to about 10.75 centimeters of their length. The samples were divided into groups designated A through D and were tested (both sides simultaneously) at a current of 20 amps and a current density of 1200 amps/m$^2$ as follows:

TABLE II

| SAMPLE GROUP | TREATMENT | | CHARGE DENSITY |
|---|---|---|---|
| A. | 20 amps/or | 30 seconds | 3.63 coulombs/cm$^2$ |
| B. | 20 amps/or | 45 seconds | 5.45 coulombs/cm$^2$ |
| C. | 20 amps/or | 90 seconds | 10.89 coulombs/cm$^2$ |
| D. | 20 amps/or | 180 seconds | 21.79 coulombs/cm$^2$ |

Again, surface insulation resistance measurements (by ASTM test method A717) were made for each sample before and after the electrochemical treatment. The results of this test are summarized in Table III below.

TABLE III

| SAMPLE | $I_1$ | $I_2$ | % | t |
|---|---|---|---|---|
| A. | .688 | .272 | 60.5 | 30 |
| B. | .677 | .165 | 75.6 | 45 |
| C. | .767 | .066 | 91.4 | 90 |
| D. | .640 | .075 | 88.3 | 180 |

Where:

I1 = average current in amperes (by ASTM test method A717) of the samples of each group before treatment.

I2 = average current in amperes (by ASTM test method A717) of the samples of each group after treatment.

% = average percent improvement in amperes of the samples of each group.

$t$ = treatment time in seconds

An improvement in surface insulation resistance was achieved with respect to each sample after the electrochemical treatment. After a treatment at a charge density of 3.63 coulombs/cm$^2$ an average improvement in surface insulation resistance of 60.5% was recorded. At treatments at a charge density greater than 3.63 coulombs/cm$^2$ the improvement in surface insulation resistance increased, but at a less pronounced rate. Finally, at treatments at a charge density greater than 1089 coulombs/cm$^2$ improvement in the surface insulation was not significant. On the other hand, at treatments at a charge density greater than 10.89 coulombs/cm$^2$ metallic removal began in regions of exposed base metal forming small pits. Metal removal then spread to adjacent regions beneath the glass film creating voids thereunder.

In view of the above, the present invention may be successfully practiced utilizing, for example, either a sodium nitrate or sodium chloride electrolyte. For sodium chloride-containing electrolytes, a concentration of up to 300 grams per liter of water may be used and it is preferred that the concentration be at or near 300 grams per liter of water to reduce the amount of power dissipated by the electrochemical treatment step. A sodium nitrate electrolyte is preferred and concentrations up to about 600 grams per liter of water may be used. Again it is preferred that the concentration be at or near 600 grams per liter of water for power dissipation considerations.

While the container for the electrolyte may serve as the cathode, it is preferred, for reasons of safety to provide a cathode of stainless steel or the like. Again for purposes of power conservation, it is preferable that the distance between the cathode and the oriented silicon steel being treated be minimized as much as is practical.

The current densities and length of time at which the electrochemical treatment is conducted should be selected largely on the basis of the quality of the insulative film on the oriented silicon steel being treated. This is well within the skill of the worker in the art and is based upon a trade-off between improvement in surface insulation resistance and possible damage to the base metal underlying the coating. Such damage, where severe, is harmful to the physical appearance and the magnetic properties of the oriented silicon steel. Also, when such damage is severe, adherance of a secondary applied coating may be poor in the damaged areas.

The fewer the number of metallic particles extending through or protruding above the surface of the primary insulative coating, the shorter the required time for effective treatment. With shorter times, there is less chance for damage due to over-treatment.

The electrochemical treatment step, should not exceed a charge density of about 10.89 coulombs/cm$^2$ because improvements in surface insulation resistance at charge densities thereabove are not significant. For most purposes, the electrochemical treatment step may be conducted at charge densities of from about 3.63 couloumbs/cm$^2$ to about 5.45 coulombs/cm$^2$. If the insulative coating is relatively free of metallic particles extending therethrough or thereabove, a current density of up to about 3.63 coulombs/cm$^2$ will normally suffice.

In practice, once a current density and length of treatment time (i.e. charge density) have been established to produce optimum results, the current density and time of treatment may be adjusted to different values and still produce the same results. It may be necessary to make the above mentioned adjustments in order to facilitate a particular method of electrochemical treatment for mill glass material. For example, if the maximum time of treatment was limited to 10 seconds, but the optimum time was 30 seconds at a current density of 1200 amps/m$^2$. (i.e. a charge density of 3.6 coulombs/cm$^2$), a new value for current density may be calculated for 10 second treatment time using the following.

where:

Q = 1200 amps/m$^2$ times 30 seconds = optimum value $t$ = time of treatment = 10

I$d$ = New current density

I$d$ = Q/I = 3600 amps/m2 at 10 seconds = a charge density of 3.6 coulombs/cm$^2$ In regular commercial practice it would be normal procedure to maintain a constant line speed and vary the current to achieve the desired charge density.

The electrochemical treatment of the present invention will be followed by a water rinse step and a drying step. Such rinsing and drying steps are well known in the art. The drying step may be accomplished, for example, by air blowing.

Modifications may be made in the invention without departing from the spirit of it.

The embodiments of the invention in which an exclusive property or privilege is claimed are defined as follows:

1. A process of improving the surface insulation resistance of an electrical steel having a primary insulative coating thereon comprising the steps of causing said steel to serve as an anode and subjecting said steel to electrochemical treatment in an electrolyte of the type which will cause the precipitation of a metal hydroxide to remove small metallic particles extending through a protruding above said insulative coating.

2. The process claimed in claim 1 wherein said electrochemical treatment step comprises a part of the routing of said electrical steel, said electrical steel being in strip form with said insulative coating thereon being caused to pass through an electrolyte bath, said electrolyte being chosen from the class consisting of an aqueous solution of sodium nitrate and an aqueous solution of sodium chloride.

3. The process claimed in claim 1 wherein said insulative coating comprises a mill glass.

4. The process claimed in claim 2 wherein said electrolyte comprises an aqueous solution of sodium nitrate having a concentration of up to about 600 grams sodium nitrate per liter of water.

5. The process claimed in claim 2 wherein said electrolyte comprises an aqueous solution of sodium chloride having a concentration of up to about 300 grams sodium chloride per liter of water.

6. The process claimed in claim 4 wherein said electrochemical treatment step is conducted at a charge density of up to about 10.89 coulombs/cm$^2$.

7. The process claimed in claim 4 wherein said electrochemical treatment step is conducted at a charge density of from about 3.63 coulombs/cm$^2$ to about 5.45 coulombs/cm$^2$.

8. The process claimed in claim 4 wherein said electrochemical treatment step is conducted at a charge density of up to about 3.63 coulombs/cm$^2$.

9. The process claimed in claim 5 wherein said electrochemical treatment step is conducted at a charge density of up to 10.89 coulombs/cm$^2$.

10. The process claimed in claim 5 wherein said electrochemical treatment step is conducted at charge density of from about 3.63 coulombs/cm$^2$ to about 5.45 coulombs/cm$^2$.

11. The process claimed in claim 5 wherein said electrochemical treatment step is conducted at a charge density of up to about 3.63 coulombs/cm$^2$.

12. The process claimed in claim 6 wherein said insulative coating comprises a mill glass.

13. The process claimed in claim 9 wherein said insulative coating comprises a mill glass.

* * * * *